US005429298A

United States Patent [19]

Chess

[11] Patent Number: 5,429,298

[45] Date of Patent: Jul. 4, 1995

[54] UNIVERSAL MAILER

[75] Inventor: Stanley Chess, Jerome, Id.

[73] Assignee: Moore Business Forms, Inc., Grand Island, N.Y.

[21] Appl. No.: 99,478

[22] Filed: Jul. 30, 1993

[51] Int. Cl.[6] ..... B65D 27/06

[52] U.S. Cl. ..... 229/305; 229/69

[58] Field of Search ..... 229/304, 305, 69; 462/64

[56] References Cited

U.S. PATENT DOCUMENTS

| | | | |
|---|---|---|---|
| Re. 33,570 | 4/1991 | Ashby . | |
| 3,104,799 | 9/1963 | Steidinger . | |
| 3,419,286 | 12/1968 | Noonan et al. | 229/69 |
| 3,428,237 | 2/1969 | Dowen | 229/305 |
| 3,554,438 | 1/1971 | Van Malderghem . | |
| 3,905,545 | 9/1975 | Juszak et al. | 229/69 |
| 3,941,308 | 3/1976 | DiGirolomo et al. . | |
| 4,002,290 | 1/1977 | Malderghem . | |
| 4,055,294 | 10/1977 | Traise | 229/304 |
| 4,095,695 | 6/1978 | Steidinger . | |
| 4,230,262 | 10/1980 | Denay et al. . | |
| 4,435,001 | 3/1984 | Mills et al. | 229/69 |
| 4,645,123 | 2/1987 | Ashby . | |
| 4,729,506 | 3/1988 | Neubauer | 229/69 |
| 4,896,822 | 1/1990 | Ashby . | |
| 4,955,526 | 9/1990 | Haase et al. . | |
| 5,011,069 | 4/1991 | Bowen et al. . | |
| 5,040,720 | 8/1991 | Pennock . | |
| 5,118,030 | 6/1992 | McNamara et al. . | |
| 5,172,855 | 12/1992 | Coffey . | |

*Primary Examiner*—Stephen P. Garbe
*Attorney, Agent, or Firm*—Nixon & Vanderhye

[57] ABSTRACT

A mailer type business form has a minimum number of insert plies by providing a remittance stub as an extension of the reply envelope. In one construction, three insert plies having lesser dimensions than the first and second main plies are sandwiched between the main plies, with the second and third insert plies defining a reply envelope front and back and with a perforation line dividing the second insert ply into a reply envelope portion and a stub portion. The first insert ply overlies the second insert ply and also has a stub portion. Image transfer is provided between the stub portions, as by a CB and a CF coating, and image transfer is also provided between the first ply and the first insert ply as by a carbonized bottom face of the first ply. A fly sheet may be provided on top of the first ply. The reply envelope can either be top or end opening. In another embodiment the second ply comprises the back of the reply envelope and includes the stub portion, so that only two insert plies are provided.

12 Claims, 2 Drawing Sheets

UNIVERSAL MAILER

BACKGROUND AND SUMMARY OF THE INVENTION

Mailer type business forms having a number of insert plies are useful for many purposes, especially where a remittance stub is removed from the original mailer construction and included with a payment in a reply envelope formed by the inserts. This basic type of mailer is shown in U.S. Re. No. 33,570, the disclosure of which is hereby incorporated by reference herein.

While the mailer type business form of U.S. Re. No. 33,570 is extremely advantageous, there are some circumstances when it is desirable to minimize the number of plies, or the size of the insert plies, or otherwise simplify the construction. According to the present invention a mailer type business form is provided which achieves these goals. A basic feature of the present invention which assists in achieving these goals is the provision of a remittance stub as part of the same ply that forms either the front or back (preferably the back) of the reply envelope. Also, image transfer means preferably are provided between a stub portion of an overlying insert ply, and the stub portion of the back of the return envelope ply.

According to a first aspect of the present invention, a mailer type business form is provided comprising the following elements: A first ply having first length and width dimensions. A second ply having substantially the same dimensions as the first ply, the first and second plies forming the front and back of the mailer. A first insert ply having second length and width dimensions both less than the first dimensions, and including a main portion and a stub portion. Second and third insert plies defining a reply envelope front and back, and a first line of weakness dividing at least the second insert ply into a main portion, comprising either the front or back of the reply envelope, and a stub portion (the insert plies are disposed between the first and second plies and accessible once the mailer is opened). And image transfer means between the stub portions of the first and second insert plies.

Preferably there is a second line of weakness in the first insert ply dividing it into the main and stub portions. The image transfer means preferably comprises a CB coating on the first insert ply and a CF coating on the second insert ply. Image transfer is preferably provided between the first ply and the first insert ply too, such as by a carbonized coating on the bottom of the first ply.

The reply envelope may either be top or end opening. A fly sheet ply may be provided overlying the first ply, or the mailer may consist of five plies (the first and second plies, and first through third insert plies). Typically the first insert ply is under the first ply, then the third insert ply (having a length substantially less than the second length so as to not interfere with the image transfer between the first and second plies), then the second insert ply and the second ply. Comparable preprinted indicia may be provided on the stub portions of the first and second insert plies.

According to another aspect of the present invention a mailer type business form is provided comprising the following elements: A first ply having first length and width dimensions. A second ply having substantially the same dimensions as the first ply, the first and second plies forming the front and back of the mailer. A first insert ply having second length and width dimensions both less than the first dimensions, and including a main portion and a stub portion. A second insert ply defining a reply envelope back, and a first line of weakness dividing the second insert ply into a main portion comprising the reply envelope back, and a stub portion, the second insert ply having substantially the second length and width dimensions; and a third insert ply disposed between the first and second insert plies and defining a reply envelope front, the third insert having a length dimension less than the second length dimension. The insert plies disposed between the first and second plies and accessible once the mailer is opened.

According to another aspect of the present invention, a mailer type business form is provided having one less insert ply than the embodiment described above. According to this aspect of the present invention the following elements are provided: A first ply having first length and width dimensions. A second ply having substantially the first length and width dimensions and forming the back of the mailer, and the back of a reply envelope, the second ply having a first line of weakness therein dividing the second ply into a main portion forming the back of the reply envelope, and a stub portion. A first insert ply having a main portion and a stub portion, the stub portions of the first inset ply and the second ply overlying each other. A second insert ply disposed between the first insert ply and the second ply, and having a second length dimension less than the length of the first length dimension by at least the width of the stub portion of the second ply, the second insert ply adhesively connected to the second ply to form the reply envelope. And image transfer means between the stub portions for transferring indicia imaged on the first insert ply first stub portion to the second ply stub portion.

The mailer may have a fly sheet, or may consist of four plies (the first and second plies, and first and second insert plies). The image transfer means preferably is provided with a CB and a CF coating on the respective stub portions, and image transfer between the first ply and first insert ply is provided in the same way as in the first embodiment.

It is a primary object of the present invention to provide an advantageous mailer type business form. This and other objects of the invention will become clear from an inspection of the detailed description of the invention, and from the appended claims.

DETAILED DESCRIPTION OF THE DRAWINGS

Figure 1:
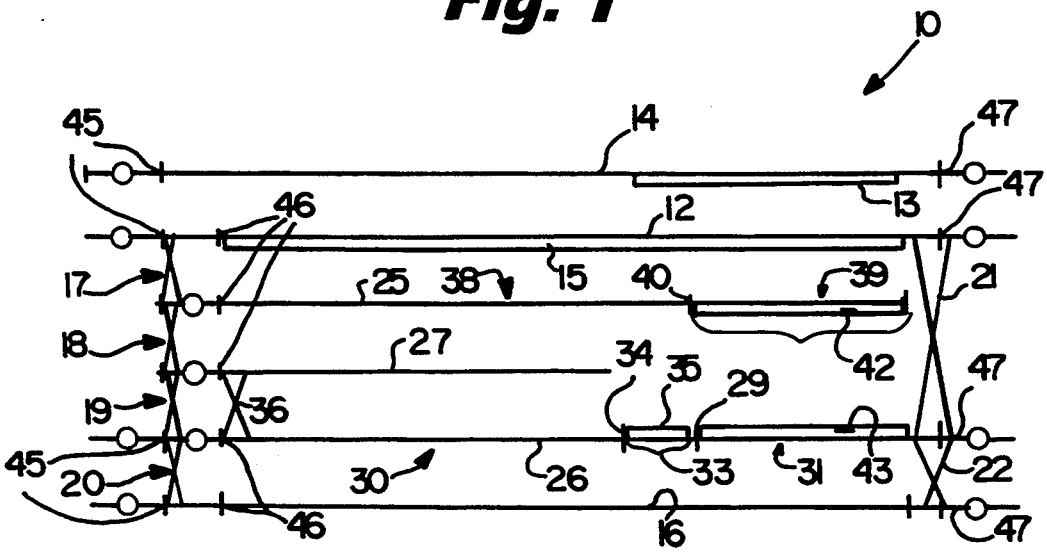
FIG. 1 is a cross section schematic view of a first embodiment of a mailer type business form according to the present invention.
Figure 2:
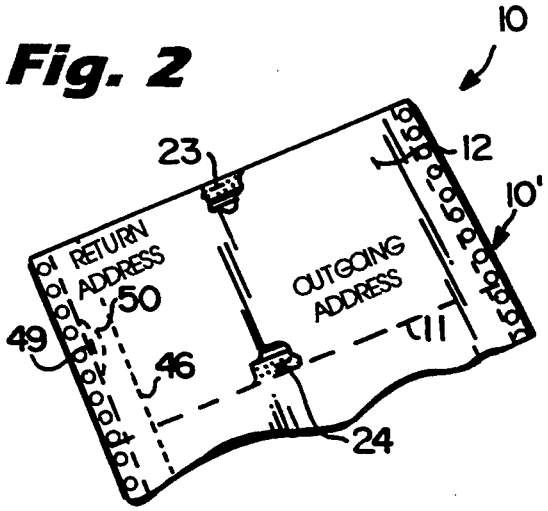
FIG. 2 is a top perspective view of the mailer of FIG. 1, shown in continuous format, with the fly sheets removed.

An exemplary mailer type business form according to the present invention is shown generally by reference numeral 10 in FIGS. 1 and 2. As illustrated in FIG. 2, the mailer 10 is typically originally in continuous format (as also illustrated in U.S. Re. No. 33,570), this being indicated schematically by the mailer 10' being connected on the perf line 11 to the mailer 10, in FIG. 2. All of the various plies of the mailer 10 are typically of paper.

The mailer 10 (see FIG. 1) includes a first ply 12, which contains the outgoing address on the top surface thereof, which outgoing address may be imprinted thereon utilizing a carbonizing spot 13 on the bottom face of a fly sheet ply 14 which is kept as a record copy. The first ply 12 also preferably comprises a carbonizing coating 15, or like image transferring means, on its bottom face so as to transfer indicia of a stylus which is impacted on the top surface of the first ply 12 to one or more underlying plies. The mailer 10 also comprises a second ply 16, the first and second plies 12, 16 being adhesively attached together to form an outgoing mailer front and back, respectively. The glue portions 17 through 22 attach the mailer components together along the side edges thereof, while additional glue strips 23, 24 (see FIG. 2) attach the first and second plies 12, 16 together along the end edges thereof.

The mailer 10 first and second plies 12, 16 have substantially the same length and width dimensions. The first, second, and third insert plies 25, 26, and 27, respectively, typically have lesser dimensions than the plies 12, 16, particularly lesser width dimensions, having width dimensions less than the spacing between the adhesive strips 23, 24.

The second insert ply 26 has a first line of weakness (e.g. perforation line) 29 which divides it into a main body portion 30 (to the left of line 29 in FIG. 1), and a stub portion 31 (to the right of perforation line 29 in FIG. 1). The stub portion 31 of ply 26 is also defined by a perforation line 48. The main portion 30 preferably comprises the back of the return envelope with the front of the return envelope being provided by the third insert ply 27. As part of the main portion 30 there preferably is a reply envelope flap 33 defined between the perforation line 29 and a fold or perforation line 34, which has rewettable adhesive or transfer tape 35 thereon.

In FIG. 1 the reply envelope formed by the insert ply 27 and portion 30 is an end opening reply envelope. The third insert ply 27 and the second insert ply 26 main portion 30 are connected together along three sides (the three sides that do not include the flap 33) by adhesive strips, only one of which—the strip 36—is visible in FIG. 1. Note that the third insert ply 27 has a length dimension substantially less than that of the first and second insert plies 25, 26, terminating at the fold or perf line 34.

The first insert ply 25 also has main and stub portions, illustrated generally by reference numerals 38 and 39, respectively, in FIG. 1. A second line of weakness (e.g. perforation) 40 may be provided in the first insert ply 25, overlying the first line of weakness 29, to define the first insert ply 25 into the main and stub portions 38, 39; or the portions 38, 39 may merely be defined by printed indicia on the top face of the insert ply 25.

Preferably, image transferring means are provided between the stub portions 39, 31 to transfer indicia impacted by a stylus on the topmost of the plies of the mailer 10 (e.g. the plies 14 or 12) to the stub portion 31, so that the stub portion 31 may comprise a remittance stub for enclosure in a reply envelope. Such image transfer means may be a carbonized back of stub portion 39, or the like, but preferably takes the form of a CB coating 42 on the bottom face of the first insert ply 25 stub portion 39, and a CF coating 43 on the top face of the second insert ply 26 stub portion 31.

As is conventional, the mailer 10 also includes marginal perfs 45 in each of the plies 12, 14, 16, 25, 26, and 27 adjacent the left edges thereof, as well as additional perforations 46 on all except for the fly sheet ply 14. Marginal perfs 47 may also be provided in the plies 12, 16, 14, and 26 adjacent the right edge thereof. To facilitate opening, a thumb notch 49 is typically provided, defined by thumb notch perforations 50, adjacent the left edge of the mailer 10, as seen in FIG. 2, and as is conventional per se.

Figure 3:
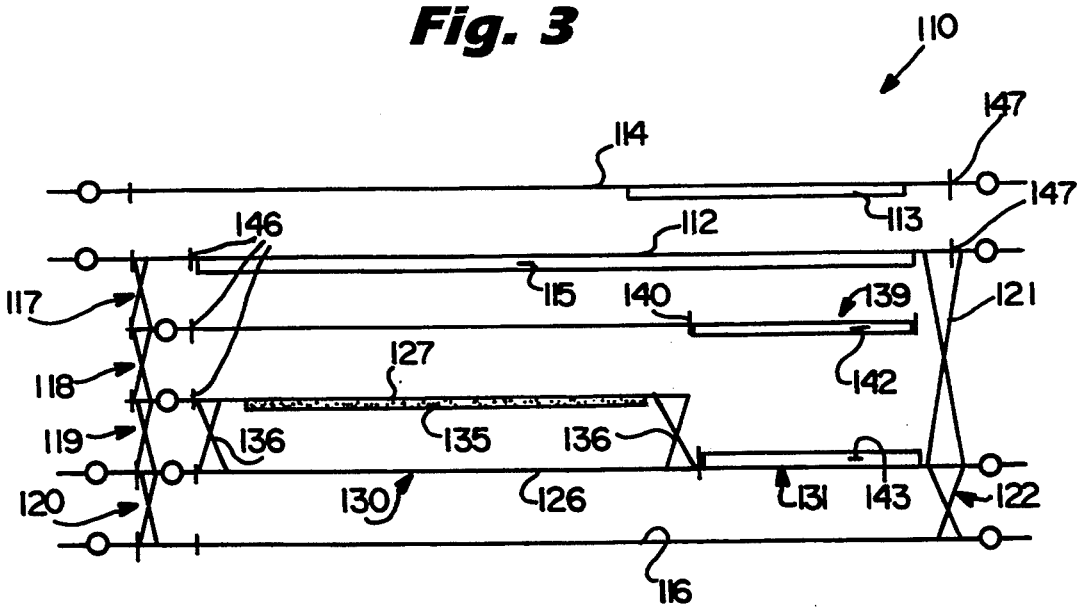
FIG. 3 is a view like that of FIG. 1 for a modified version of mailer.

FIG. 3 illustrates a mailer 110 which is a modified form of the mailer 10 of FIGS. 1 and 2. In the FIGS. 3 and 4 embodiment (FIG. 4 illustrating the insert plies of the FIG. 3 embodiment in plan view), components comparable to those in the FIGS. 1 and 2 embodiment are shown by the same reference numerals only preceded by a "1", and the common structures therefore will not be specifically described, but reference is directed to the corresponding structures described above with respect to the FIGS. 1 and 2 embodiment.

Figure 4:
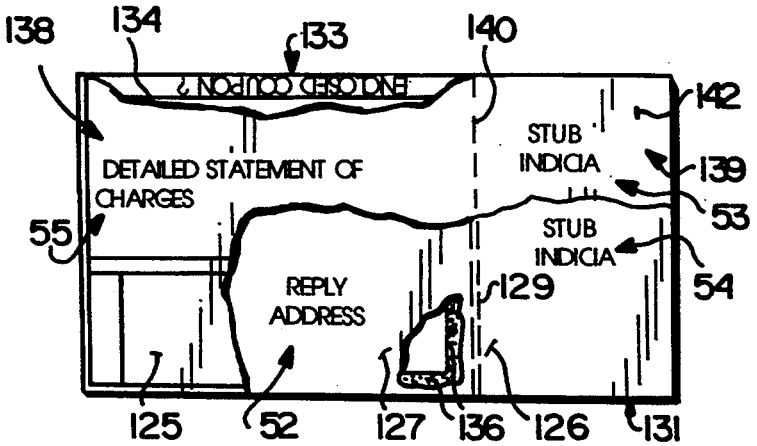
FIG. 4 is a top plan view, with portions cut away for clarity of illustration, of the first insert ply of the embodiment of FIG. 3, with portions of the second and third insert plies being visible where overlying portions are cut away.

In the embodiment of FIGS. 3 and 4, the reply envelope provided by the third insert ply 127 and the main portion 130 of the second insert ply 126 has a top opening construction, the flap 133 being illustrated in FIG. 4, and being defined in the third insert ply 127. Two of the strips of adhesive 136 holding the third insert ply 127 and main portion 130 of the second insert ply 126 together to form a reply envelope are illustrated in FIG. 3.

FIG. 4 illustrates the reply address indicia 52 which is imaged on the top face of the third insert ply 127, and also schematically illustrates preprinted indicia 53, 54—which may be the same indicia, or at least include a number of portions that are the same—which are provided on the stub portions 139, 131 of the first insert ply 125 and second insert ply 126, respectively, as seen in FIG. 4. Other indicia 55 is also preferably printed on the main portion 138 of the first insert ply 125.

Figure 5:
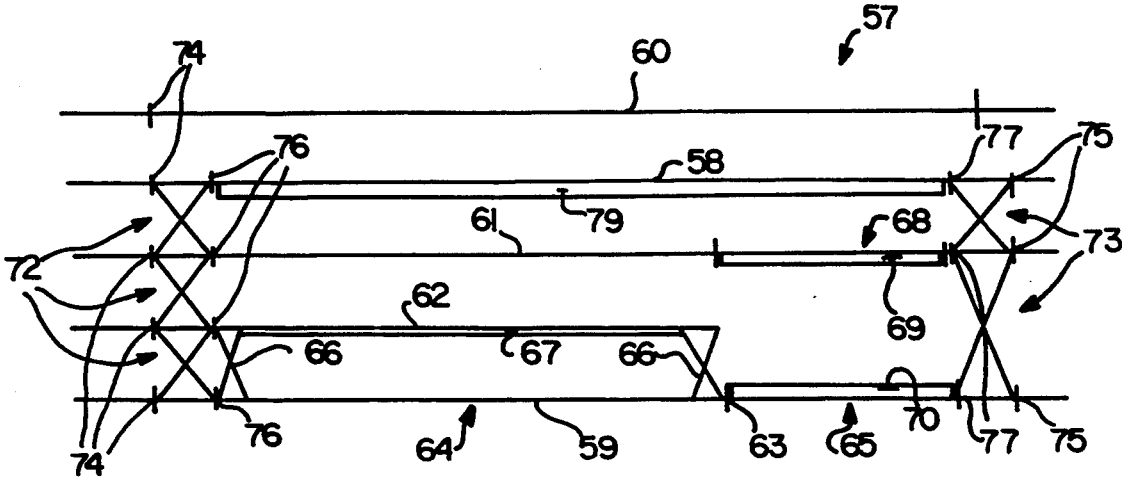
FIG. 5 is a view like that of FIG. 1 of yet another exemplary embodiment of mailer according to the invention.

FIG. 5 illustrates another embodiment of mailer 57 according to the present invention. This embodiment includes a first ply 58 and a second ply 59 which define the front and back of the outgoing mailer, having the optional fly sheet ply 60 overlying the first ply 58. In this embodiment, however, only two insert plies are provided, and the second, bottom, ply 59 also defines the back of the reply envelope.

In the mailer 57, first insert ply 61 has substantially the same length dimension as the first and second plies 58, 59, and 60 although a lesser width (less by the width of the adhesive strips along the end edges holding the plies 58, 59 together), while the second insert ply 62 has lesser length dimensions than the plies 58, 59.

In the mailer 57, a first line of weakness 63 defines the bottom ply 59 into a main portion 64 (comprising the back of the reply envelope) and a stub portion 65, which serves as a remittance stub. In the embodiment illustrated in the drawing in FIG. 5, a top opening reply envelope is provided having the adhesive strip 66 along the side edges thereof, and the rewettable glue strip or transfer tape 67 formed on a flap portion (not shown) of the second insert ply 62, thus having the same basic construction as the reply envelope in the FIGS. 3 and 4 embodiment. With respect to the embodiment shown in FIG. 5, ply 61 is die cut top and bottom. Ply 62 is not die cut. Ply 59 is glued to ply 62 on the left-hand side. Ply 62 is also glued along the left-hand side to ply 58. It is to be understood, however, that an end opening reply envelope—such as in the FIG. 1 embodiment—may also be provided.

Image transfer between the first insert ply 61 stub portion 68, and the stub portion 65 may be provided by a carbonized coating on the bottom face of the first insert ply 61 or—as illustrated in FIG. 5—by a CB coating 69 on the bottom of stub portion 68, and a CF coating 70 on the top of stub portion 65. Suitable other glue strips 72, 73, and margin and additional perforations or slits 74–77, are also provided, comparable to similar perforations or slits in the FIGS. 1 through 4 embodiments. The FIG. 5 embodiment thus consists of five paper plies (if the fly sheet ply 60 is provided), or four plies. The mailer 57 may also have other features in common with the FIGS. 1 through 4 embodiments, such as the carbonized coating 79 on the bottom face of the first ply 58, etc.

It will thus be seen that according to the present invention an advantageous mailer type business form construction has been provided. While the invention has been herein shown and described in what is presently conceived to be the most practical and preferred embodiment, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A mailer type business form comprising:

a first ply having first length and width dimensions;

a second ply having substantially the same dimensions as said first ply, said first and second plies forming the front and back of said mailer;

a first insert ply having second length and width dimensions, at least one of which is less than said first dimensions, and including a main portion and a stub portion;

second and third insert plies defining a reply envelope front and back, and a first line of weakness dividing at least said second insert ply into a main portion, comprising either the front or back of said reply envelope, and a stub portion;

said insert plies disposed between said first and second plies and accessible once said mailer is opened; and image transferring means between said stub portions of said first and second insert plies.

2. A mailer as recited in claim 1 further comprising a second line of weakness formed in said first insert ply which divides said first insert ply into main and stub portions, said second line of weakness overlying said first line of weakness.

3. A mailer as recited in claim 2 further comprising comparable preprinted indicia on said stub portions of said first and second insert plies, and reply address indicia on said third insert ply.

4. A mailer as recited in claim 1 wherein said image transferring means comprises a CB coating on said first insert ply stub portion, and a CF coating on said second insert ply stub portion.

5. A mailer as recited in claim 1 wherein said reply envelope comprises a top opening reply envelope.

6. A mailer as recited in claim 1 wherein said reply envelope comprises an end opening reply envelope.

7. A mailer as recited in claim 1 further comprising a fly sheet ply overlying said first ply and having substantially said first length and width dimensions.

8. A mailer as recited in claim 1 consisting essentially of said first and second plies, and first, second, and third insert plies.

9. A mailer as recited in claim 1 further comprising marginal perforations formed in said first and second plies to facilitate opening of the mailer to expose said insert plies.

10. A mailer as recited in claim 1 wherein said first insert ply underlies said first ply, said third insert ply underlies said first insert ply, and said second insert ply underlies said third insert ply, said third insert ply having a length dimension substantially less than said second length dimension, and said second insert ply having substantially said second length dimension, so that said third insert ply does not interfere with said image transferring means between said first and second insert plies.

11. A mailer as recited in claim 1 further comprising second image transferring means between said first ply and said first insert ply.

12. A mailer as recited in claim 11 wherein said second image transferring means comprises a carbonized bottom face of said first ply.

* * * * *